US005102357A

United States Patent [19]

Bruesch et al.

[11] Patent Number: 5,102,357

[45] Date of Patent: Apr. 7, 1992

[54] MARINE DRIVE SWIVEL BRACKET WITH TIGHTENED AND RETAINED CLAMP BAND

[75] Inventors: Edward A. Bruesch, Waupun; Ralph E. Anderson, Oshkosh, both of Wis.

[73] Assignee: Brunswick Corporation, Skokie, Ill.

[21] Appl. No.: 638,731

[22] Filed: Jan. 8, 1991

[51] Int. Cl.[5] ..... B63H 21/26

[52] U.S. Cl. ..... 440/53; 440/900; 248/643

[58] Field of Search ..... 403/DIG. 9, 344, 373, 403/104; 440/53, 900; 248/643; 24/20 LS

[56] References Cited

U.S. PATENT DOCUMENTS 3,174,357 3/1965 Conklin ..... 440/53 X

OTHER PUBLICATIONS

Mercury Marine, Brunswick Corp., Catalog M0027-M24, pp. 26, 27, "Swivel Bracket Assembly", 20/25 HP, Sep. 1989.

*Primary Examiner*—Sherman Basinger

*Attorney, Agent, or Firm*—Andrus, Sceales, Starke & Sawall

[57] ABSTRACT

The transom mounted swivel bracket (16) of an outboard marine drive (10) has a clamp (36) with a pair of spaced parallel end tabs (40, 42) having aligned apertures (54, 56). A screw (58) has a leading end extension (68) extending through the apertures (54, 56) in the tabs (40, 42), and a shoulder (66) engaging one of the tabs and driving the one tab (40) toward the other tab (42) as the screw (58) is turned further into the swivel bracket (16), such that the clamp band (36) is tightened around the steering tube (20) to increase frictional steering resistance. The other tab (42) is held and retained by the leading end extension (68) which prevents deformation yielding movement of the other tab (42) into the tubular portion (18) of the swivel bracket (16).

5 Claims, 2 Drawing Sheets

MARINE DRIVE SWIVEL BRACKET WITH TIGHTENED AND RETAINED CLAMP BAND

BACKGROUND AND SUMMARY

The invention relates to outboard marine drives, and more particularly to the swivel bracket clamping assembly providing frictional steering resistance.

An outboard marine drive is mounted to the transom of a boat by a transom bracket. A swivel bracket is mounted to the transom bracket and has a generally vertically extending tubular portion receiving a vertical tube of a swivel head assembly supporting an engine above the swivel head assembly and a lower drive unit below the swivel head assembly. The tube rotates in the tubular portion about a vertical axis to steer the boat. A clamp band in the swivel bracket extends circumferentially around the tube and has a pair of spaced generally parallel end tabs extending radially outwardly into a recess in the swivel bracket.

In the prior art, a screw is threaded into a threaded hole in the swivel bracket and engages one of the tabs to drive the one tab toward the other tab, such that the clamp band is tightened around the tube to increase frictional steering resistance. A problem encountered in the prior art is that the noted other tab may yield and deform and move into the tubular portion, making the clamp band ineffective, particularly when overtorqued.

The present invention addresses and solves the noted problem with a tightening assembly which not only tightens the clamp band but also retains the tabs and prevents deformation yielding movement thereof into the tubular portion. This enables the user to increase the steering friction as desired.

BRIEF DESCRIPTION OF THE DRAWINGS

Prior Art

Present Invention

Figure 3:
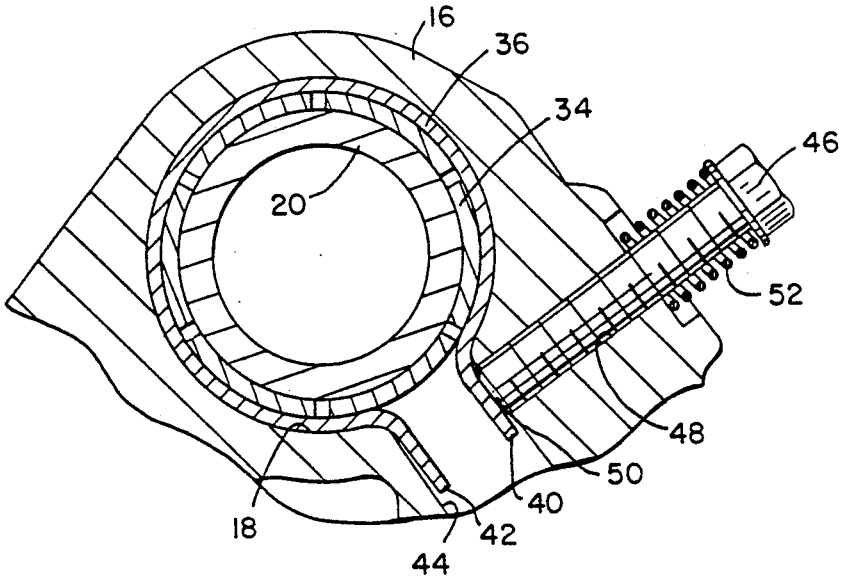
FIG. 3 PRIOR ART
FIG. 3 is an enlarged sectional view taken along line 3—3 of FIG. 1.
Figure 4:
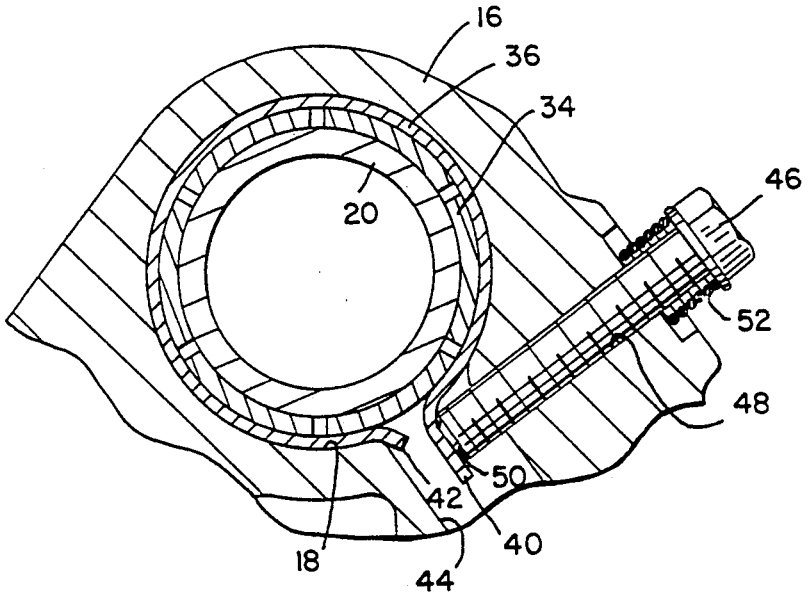
FIG. 4 PRIOR ART
FIG. 4 is a view like FIG. 3 and shows another condition of the clamp band.
Figure 5:
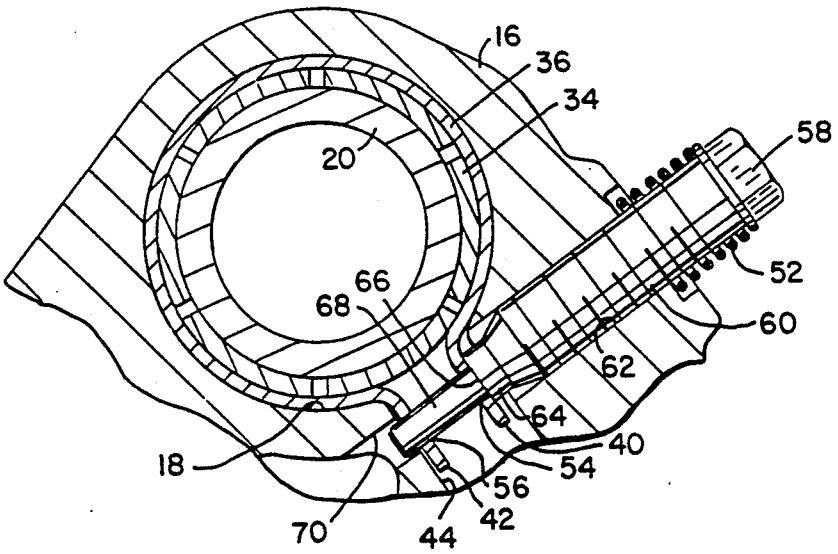

FIG. 5 is a view like FIGS. 3 and 4 and shows the present invention.

DETAILED DESCRIPTION

Prior Art

Figure 1:
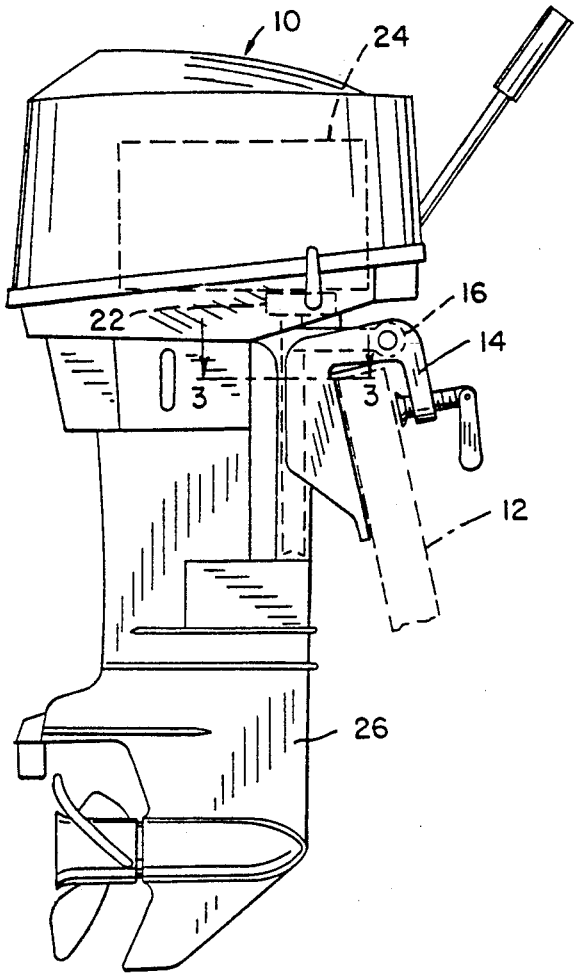
FIG. 1 PRIOR ART
FIG. 1 shows an outboard marine drive.
Figure 2:
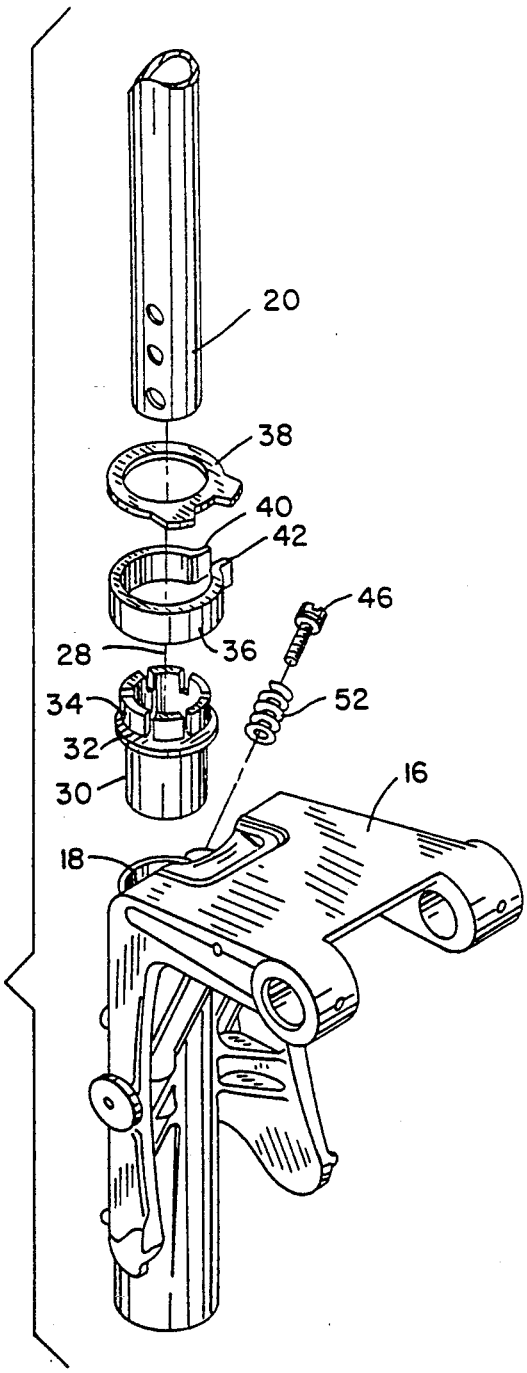
FIG. 2 PRIOR ART
FIG. 2 is an exploded perspective view of a portion of the marine drive of FIG. 1.

FIG. 1 shows an outboard marine drive 10 mounted to the transom 12 of a boat by a transom bracket 14. A swivel bracket 16, FIG. 2, is mounted to the transom bracket and has a generally vertically extending tubular portion 18 receiving a vertical tube 20 of a swivel head assembly 22, for which further reference may be had to Mercury Marine, Brunswick Corp., Catalog M0027-M24, pages 26, 27, "Swivel Bracket Assembly", 20/25 HP, Sept. 1989. The swivel head assembly supports an engine 24 above the swivel head assembly, and a lower drive unit 26 below the swivel head assembly. Tube 20 rotates in tubular portion 18 about vertical axis 28 to steer the boat. Sleeve 30 is received in tubular portion 18 and has a central flange 32 resting on the top of tubular portion 18. Tube 20 is received in sleeve 30. The upper portion of the sleeve is castellated at 34 for frictional gripping of tube 20 upon tightening of clamp band 36 which extends circumferentially around castellated portion 34 and tube 20, FIG. 3. Clamp band 36 rests on flange 32. Washer 38 rests on clamp band 36 and supports the top of the swivel head assembly thereon, for which further reference may be had to the above noted Mercury Marine Catalog.

Clamp band 36 has a pair of spaced generally parallel end tabs 40 and 42 extending outwardly into a recess 44, FIG. 3, in swivel bracket 16. A screw 46 is threaded into a threaded hole 48 in the swivel bracket and has a leading end 50 engaging tab 40 and driving tab 40 toward tab 42 to tighten clamp band 36 and increase frictional steering resistance. Spring 52 biases screw 46.

A problem encountered in the prior art is illustrated in FIG. 4. Upon turning screw 46 into hole 48 in swivel bracket 16, tab 40 moves toward tab 42. However, upon overtorqueing, tab 42 is subject to deformation yielding movement into tubular portion 18, rendering the clamp ineffective.

Present Invention

FIG. 5 illustrates the present invention and uses like reference numerals from FIGS. 1–4 where appropriate to facilitate understanding. Tabs 40 and 42 of clamp band 36 are provided with aligned apertures 54 and 56 therethrough. Screw 58 has a threaded portion 60 threaded into threaded hole 62 in swivel bracket 16. Screw 58 also has a middle portion 64 forming a shoulder 66 with a reduced diameter leading end extension 68 extending through apertures 54 and 56 in tabs 40 and 42. Shoulder 66 engages tab 40 and drives tab 40 toward tab 42 as screw 58 is turned further into hole 62 in swivel bracket 16 in threaded relation, such that the clamp band is tightened around castellated portion 34 and tube 20 to increase friction steering resistance. Tab 42 is held and retained by leading end extension 68, which prevents deformation yielding movement of tab 42 into tubular portion 18. Swivel bracket 16 has an extension hole 70 therein aligned with threaded hole 62 and spaced therefrom across recess 44. Leading end extension 68 extends through apertures 54 and 56 in tabs 40 and 42 in recess 44 and into extension hole 70. The invention not only tightens the clamp band but also retains tabs 40 and 42 and prevents deformation yielding movement thereof into tubular portion 18. The tightening and retaining structure engages both tabs and holds them in generally parallel relation, including in tightened condition of the clamp band. This enables the user to increase steering friction as desired.

It is recognized that various equivalents, alternatives and modifications are possible within the scope of the appended claims.

We claim:

1. In an outboard marine drive mounted to the transom of a boat by a transom bracket, a swivel bracket mounted to said transom bracket and having a generally vertically extending tubular portion receiving a vertical tube of a swivel head assembly supporting an engine above said swivel head assembly and a lower drive unit below said swivel head assembly such that said tube rotates in said tubular portion about a vertical axis to steer the boat, a clamp band in said swivel bracket extending circumferentially around said tube and having a pair of spaced generally parallel end tabs extending radially outwardly into a recess in said swivel bracket, tightening and retaining means mounting said clamp band in said tubular portion of said swivel bracket and preventing rotation of said clamp band relative to said tubular portion of said swivel bracket and permitting rotation of said vertical tube of said swivel head assembly within said clamp band, said tightening and retaining means driving one of said tabs toward the other of said tabs and also preventing deformation yielding movement of said other tab into said tubular portion, such that said clamp band is tightened around said tube to increase frictional steering resistance without loss of frictional gripping of said tube by said band otherwise caused by deformation yielding movement of said other tab into said tubular portion.

2. The invention according to claim 1 wherein said tightening and retaining means engages each of said tabs.

3. The invention according to claim 2 wherein said tightening and retaining means maintains said tabs in generally parallel relation including when said clamp band is tightened around said tube.

4. In an outboard marine drive mounted to the transom of a boat by a transom bracket, a swivel bracket mounted to said transom bracket and having a generally vertically extending tubular portion receiving a vertical tube of a swivel head assembly supporting an engine above said swivel head assembly and a lower drive unit below said swivel head assembly such that said tube rotates in said tubular portion about a vertical axis to steer the boat, a clamp band in said swivel bracket extending circumferentially around said tube and having a pair of spaced generally parallel end tabs extending radially outwardly into a recess in said swivel bracket, said tabs having aligned apertures therethrough, a screw having a threaded portion threaded into a threaded hole in said swivel bracket, said screw having a central portion forming a shoulder with a reduced diameter leading end extension, said leading end extension extending through said apertures in said tabs, said shoulder engaging one of said tabs and driving said one tab toward the other tab as said screw is turned further into said swivel bracket in threaded relation, such that said clamp band is tightened around said tube to increase frictional steering resistance, said other tab being held by said leading end extension which prevents deformation yielding movement of said other tab into said tubular portion.

5. The invention according to claim 4 wherein said swivel bracket has an extension hole therein aligned with said threaded hole and spaced therefrom across said recess, such that said leading end extension extends through said apertures in said tabs in said recess and into said extension hole.

* * * * *